United States Patent [19]

Santiago

[11] Patent Number: 4,993,158

[45] Date of Patent: Feb. 19, 1991

[54] GUNSIGHT

[76] Inventor: Julio A. Santiago, 13713 Susan La., Burnsville, Minn. 55337

[21] Appl. No.: 493,696

[22] Filed: Mar. 15, 1990

Related U.S. Application Data

[63] Continuation-in-part of Ser. No. 441,621, Nov. 27, 1989, and a continuation-in-part of Ser. No. 214,726, Jul. 1, 1988, Pat. No. 4,918,823, which is a continuation-in-part of Ser. No. 145,030, Jan. 19, 1988, abandoned.

[51] Int. Cl.[5] ..... F41G 1/00

[52] U.S. Cl. ..... 33/253; 33/243; 33/233

[58] Field of Search ..... 33/233, 234, 241–245, 33/261; 42/100

[56] References Cited

U.S. PATENT DOCUMENTS

| | | | |
|---|---|---|---|
| 837,563 | 12/1906 | Hartman | 33/243 |
| 1,174,063 | 3/1916 | Frank | 33/273 |
| 1,225,592 | 5/1917 | Borgo | 33/241 X |
| 1,363,553 | 12/1920 | Barringer . | |
| 1,718,458 | 6/1929 | Hager et al. . | |
| 1,851,189 | 3/1932 | King | 33/243 |
| 2,586,807 | 2/1952 | Fowler . | |
| 2,706,335 | 4/1955 | Munsey | 33/241 |
| 3,028,674 | 4/1962 | Luebkeman . | |
| 3,190,002 | 6/1965 | Bliss . | |
| 3,386,171 | 6/1968 | Luebkeman . | |
| 3,641,676 | 2/1972 | Knutson et al. . | |
| 3,698,091 | 10/1972 | Merrill et al. . | |
| 3,698,092 | 10/1972 | Rosenhan . | |
| 3,984,917 | 10/1976 | Korzeniewski . | |
| 4,244,114 | 1/1981 | Strahan . | |
| 4,375,725 | 3/1983 | Orlob | 33/241 X |
| 4,663,878 | 5/1987 | Beretta . | |
| 4,679,344 | 7/1987 | Jolly . | |
| 4,713,889 | 12/1987 | Santiago . | |

FOREIGN PATENT DOCUMENTS

| | | |
|---|---|---|
| 665662 | 6/1939 | Fed. Rep. of Germany . |
| 2262965 | 6/1973 | Fed. Rep. of Germany . |

*Primary Examiner*—Harry N. Haroian

*Attorney, Agent, or Firm*—Jacobson & Johnson

[57] ABSTRACT

A both eyes open channel sight where the vision of one eye is shielded from the sighting picture by the channel walls of the channel sight. In one embodiment the channel sight has a pair of parallel light reflecting surfaces that are located at the topmost portion of the gunsight to enable the user to quickly align the channel sight with a target with both eyes open. Located in the channel sight is a sight post that has a changeable colored or translucent insert to permit the user to have a channel sight post with a color that contrasts with the target. In another embodiment the channel sight is combined with a flip up rear sight so the user can aim with both eyes open so the user has the option of selecting one of two precise aiming positions by using only the channel sight or both the channel sight and a rear sight.

26 Claims, 12 Drawing Sheets

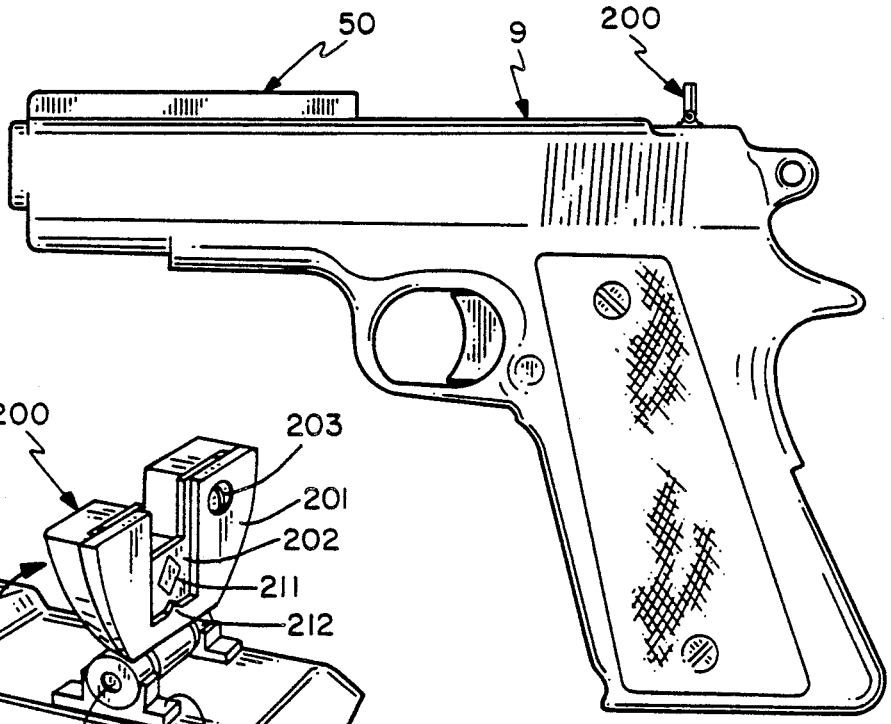
FIG. 24
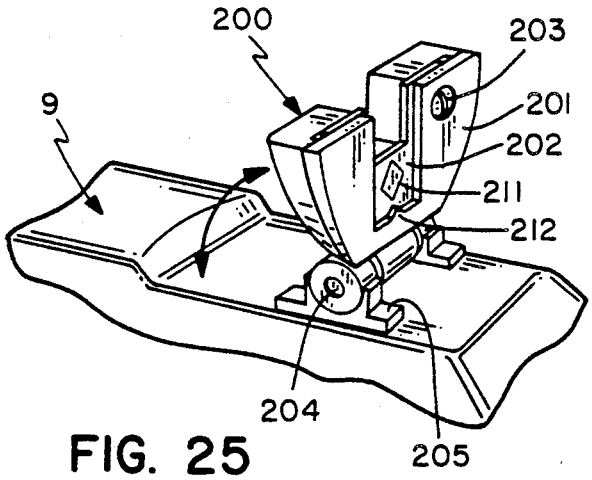
FIG. 25
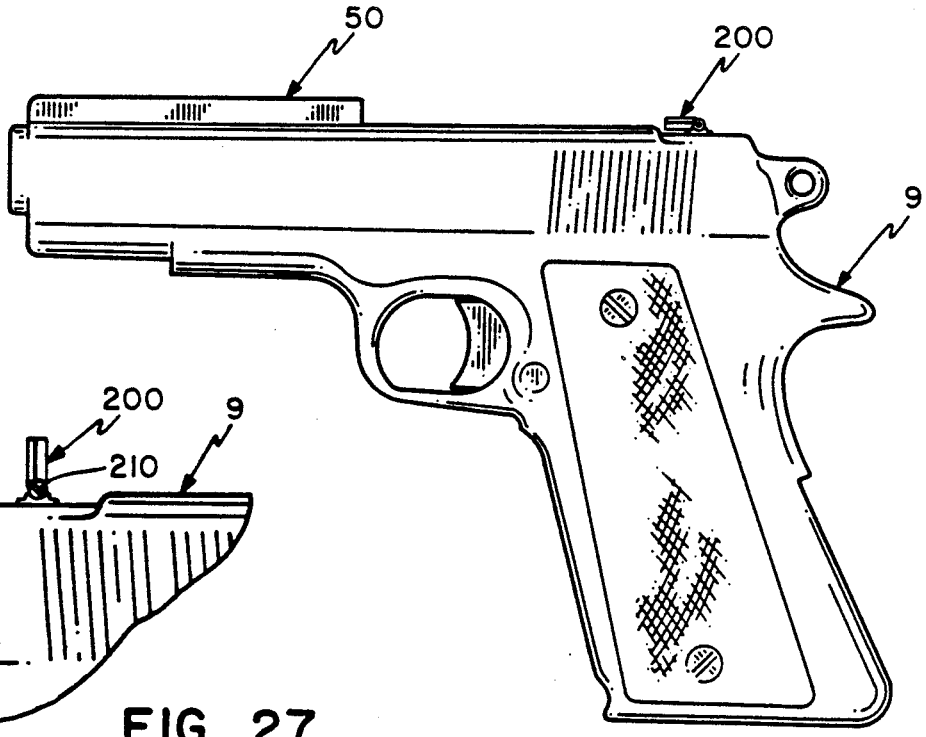
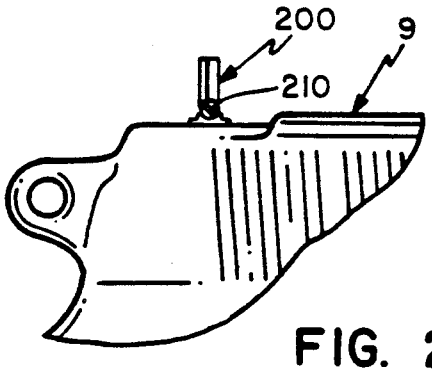
FIG. 27
FIG. 26

GUNSIGHT

CROSS REFERENCE TO RELATED APPLICATIONS

This application is a continuation-in-part of my copending U.S. continuation-in-part patent application title GUNSIGHT Ser. No. 441,621 which was filed Nov. 27, 1989, and my U.S. patent application titled GUNSIGHT Ser. No. 214,726, which was filed July 1, 1988, now U.S. Pat. No. 4,918,823 as a continuation-in-part of my U.S. patent application Ser. No. 145,030, titled GUNSIGHT which was filed Jan. 19, 1988 now abandoned.

FIELD OF THE INVENTION

This invention generally relates to gunsights and, more particularly, to a gunsight that can be rapidly aimed with both eyes open.

BACKGROUND OF THE INVENTION

My U.S. Pat. No. 4,713,889 discloses an illuminated gunsight for mounting on a weapon to permit the user to aim and shoot in both daytime conditions and low-light conditions. The sighting device includes a U-shaped channel with a pair of fluorescent lines located along the bottom of the sighting channel. The fluorescent lines act as quick reference to enable the user to quickly sight in on the target. In the daytime use of the gunsight shown in my patent, the user's eye is first drawn to the fluorescent lines followed by the user peering through the channel to locate the target.

My present invention also uses a U-shaped channel with sighting lines to enable the user to even more quickly aim a weapon. Briefly, the present invention utilizes the sighting surfaces on the topmost surfaces of the sights so that the eye does not have to search in the channel for the fluorescent sighting lines. That is, with the sight shown in my patent, if the weapon is not in initial alignment with the target the user only sees a portion of the fluorescent sighting strips. With my present invention the user immediately sees the location of the entire sighting surfaces even if the weapon is not in alignment with the target, since the sight lines are on top of the sighting channel. For example, if the user has to rotate the weapon to get the sights into initial alignment, the user can readily do so since the sighting surfaces are located on top of the sighting channel and thus readily visible to the user because the sighting surfaces are not obscured by the sidewalls of the gunsight.

The present invention further differs from the sighting device shown in my U.S. Pat. No. 4,713,889 in the manner of location of the gunsight. The gunsight shown in my patent mounts along the entire length of the barrel of a hand gun or revolver whereas the present invention can be mounted on the portion of a semi-automatic pistol slide in front of the ejection port, yet still provide an accurate sight. The present invention can also be adapted to revolvers and hand-held weapons.

In one embodiment the present invention includes a front sight post with an opening therein where the user can exchange colored inserts to provide the sight post with a color that contrasts with the target.

In another embodiment the present invention includes a foldable rear sight in conjunction with my front sight to permit a user to aim a gun in either of two modes, the both eyes open quick aim channel sight mode, or the both eyes open two sight mode that uses my channel sight as a front sight and a foldable rear sight located behind my channel sight.

In another embodiment the invention includes a permanent rear sight for use in conjunction with my channel sight to permit the user to have the advantage of both eyes open shooting when a conventional sight picture is presented to the user.

DESCRIPTION OF THE PRIOR ART

The Beretta U.S. Pat. No. 4,663,878 shows a channel sight with front and rear sight posts extending into the channel to provide a sight line on the weapon.

The Korzeniewski U.S. Pat. No. 3,984,917 shows a channel sight with elevated front sight posts to be used with the rear sight on the weapon.

The Luebkeman U.S. Pat. No. 3,028,674 shows a sight that includes a front sight post that extends across the channel on the top of his weapon.

The Luebkeman U.S. Pat. No. 3,386,171 shows a gunsight with a tapered channel as a rear sight and a front sight post located in front of the channel. The channel includes three internal extending dividers.

The Rosenhan U.S. Pat. No. 3,698,092 shows an illuminated gunsight with use of separate channel sights on the front and rear of the weapon together with conventional sights located adjacent the channels.

The Merrill U.S. Pat. No. 3,698,091 shows a sight similar to the Rosenhan sight.

The Barringer U.S. Pat. No. 1,363,553 shows a sight with a bright strip to guide the users eye to the sight.

The Jolly U.S. Pat. No. 4,679,344 shows a pistol with a luminescent material so as to be visible in low light conditions.

The Hager, et al. U.S. Pat. No. 1,718,458 shows a channel type sides where the sides coverage toward the front of the sight.

The German patent No. 665662 shows a flared sight post with a luminous material on the sight post.

The Munsery U.S. Pat. No. 2,706,335 shows a gunsight with a luminescent bead located on the front sight of a two sight weapon.

The Hartmen U.S. Pat. No. 837,563 shows a sight for a firearm that has colored markings next to the sights to serve as guide-points.

The Orlob U.S. Pat. No. 4,375,725 shows an optical sight that uses a lens to produce a virtual and magnified image of the front sight.

The Borgo U.S. Pat. No. 1,225,592 shows a night sight that uses salt of radium to emit light, from the back of the front and rear sights.

The King U.S. Pat. No. 1,851,189 shows a shot gun sight that uses an ivory bead as the front sight post.

The Frank U.S. Pat. No. 1,174,063 shows a gunsight with a curved opening in a front sight with a bead of a light colored material located in the bottom of the curved front sight.

BRIEF DESCRIPTION OF THE DRAWINGS

FIG. 18 shows a sight picture with a disposable insert having a color that contrasts with the target the user is shooting at;

FIG. 24 is a first side view of a handgun with my channel sight and a flip up rear sight;

FIG. 25 is a perspective of the flip up rear sight of FIG. 24;

FIG. 26 is a first side view of a handgun of FIG. 24 with the flip up rear sight in the down position;

FIG. 27 is a partial side view showing the opposite side view of the flip up rear sight;

BRIEF SUMMARY OF THE INVENTION

Briefly, the present invention comprises a both eyes open channel gunsight where the vision of one eye is shielded from the sighting picture by the channel walls of my channel sight. In one embodiment my channel gunsight has a pair of parallel light reflecting surfaces that are located at the topmost portion of the gunsight surface to enable the user to initially align the channel gunsight with a target while both eyes were open. Located in the channel sight is a sight post that has an opaque, colored, or translucent insert to permit the user to have a channel sight post with a color that contrasts with the target. In another embodiment the channel sight is combined with a rear sight so the user has the option of both eyes open aiming by using either the channel sight or both the channel sight and the rear sight.

DESCRIPTION OF THE EMBODIMENTS

Figure 1:
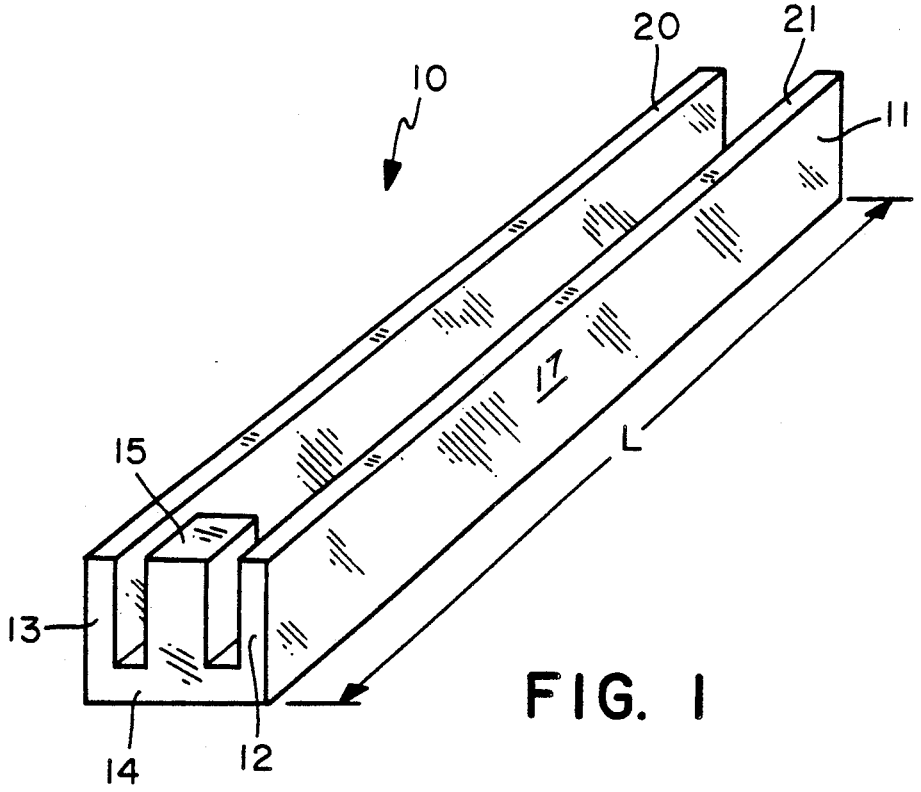
FIG. 1 is a perspective view of my sighting device for mounting on top of a weapon.

Referring to FIG. 1 reference numeral 10 identifies my channel sight for mounting on a pistol or handgun. My sight comprises a U-shaped channel 11 formed by a first rectangular shaped sidewall 12, a bottom section 14 and a second rectangular shaped sidewall 13. Located on top of sidewall 12 is a light reflecting surface 21 and located on top of sidewall 13 is a light reflecting surface 20 which is parallel to light reflecting surface 12. Light reflecting surfaces 12 and 13 are located on the topmost portion of sight 10 and provide prominent surfaces that contrast with the handgun to permit a user to quickly aim the weapon in daylight conditions without the user closing one eye. That is, the heavy light reflecting parallel lines 20 and 21 vividly contrast with the dark background of the handgun and almost immediately permit the user to line up the target with the parallel line sights on the weapon. Typically, the light reflecting surfaces may be a polished metal surface or a fluorescent surface that vividly contrasts with the top of the gun and the rest of the gunsight. Once the user has aligned the target with the parallel light reflecting lines, the predominant eye of the user automatically permits the user to align the sight post 15 with the target. Even if the user's nondominant eye is open during the sighting process, the sidewall of the channel sight shields the view for the nondominant eye, thus preventing the user from seeing a double image. Consequently, the user can aim and shoot a weapon without having to close one eye and without having to search for the sights on the front and back of the weapon since the sight lines on the top of the gunsight quickly direct the user's sight picture into the sighting channel.

Figure 2:
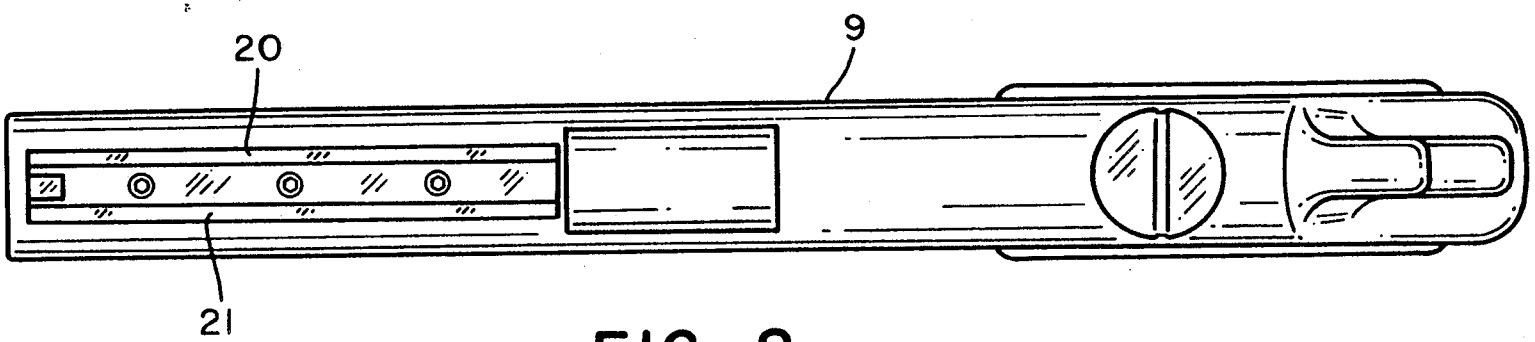
FIG. 2 is top view of the sight of FIG. 1 mounted on the top of a hand gun having a light absorbing surface.

FIG. 2 illustrates the contrasting view presented to the shooter by the sights which are located on top of a weapon 9. Sight lines 20 and 21 vividly contrast with the weapon and are located on top of the channel rather than in the channel as shown in my U.S. Pat. No. 4,713,889. The location of the parallel sight lines on top of my channel sight rather than at the bottom of the channel has been found to permit the user to more quickly locate and align the target and the weapon since the sight lines are not in the shadow of the channel walls. Thus in the present sighting system the eyes are drawn to the reflective and highly visible sight lines located on top of the channel since there are no obstructions to distract the eyes or to obscure the target. The eyes can then be drawn into the bottom of my sighting channel whereas in my prior sight system with the sight lines located in the channel, the eyes are drawn into the bottom of the channel and then aligned around the sight post before a user can properly align the sights with the target. Since sight lines located in the bottom of the channel may be partially obscured by the sidewalls of the channels, the user may not be able to quickly align the sights with the target.

The present invention also permits the user to use the sight lines on the top of the channel as the sole means of aligning the sights with the target if the user has to shoot quickly and at close range.

Figure 3:
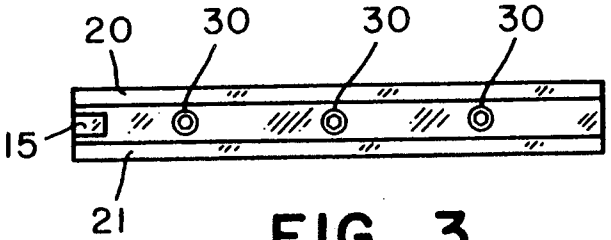
FIG. 3 is top view of my sighting device illustrating the sight post and the means for mounting the sight to a weapon.

A reference to FIG. 3 illustrates a top view of channel sight 10 which illustrates that in a top view the front sight post 15 is visible but does not have a top reflecting surface as do surface 20 and 21 which form the sight lines. Sight line 20 and sight line 21 are identical in size and length and in their reflective appearance so as to not draw the user's eye to one sight line or the other sight lines. Sight lines 20 and 21 are approximately 2½ inches long and approximately ¼ inches to provide highly visible surfaces to permit the user to quickly zero in on the target once the sight lines are located. FIG. 3 also illustrates the openings 30 which permit one to mount sight 30 on top of a weapon.

Figure 4:
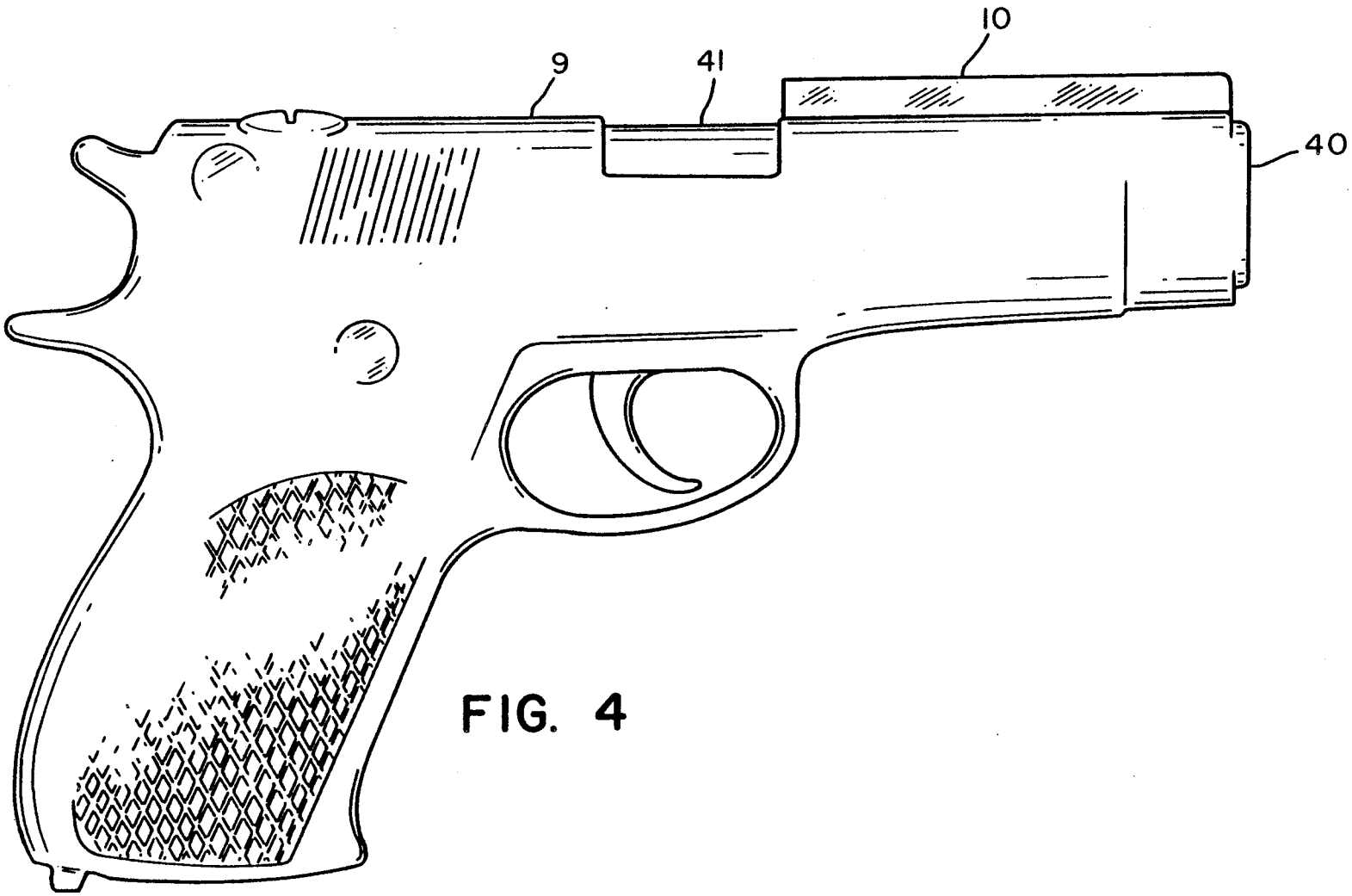
FIG. 4 is a side view of a hand gun having my channel sighting device located in front of the ejection port.

FIG. 4 shows a side view of an automatic hand gun with my channel sight located on the front portion of the barrel 40. A further feature of the present invention is that the sights are not required to be spaced at the front and rear of the handgun as with conventional post sights. FIG. 4 illustrates that my channel sight is only located on the portion of the barrel in front of the ejection ports for spent casings.

Figure 5:
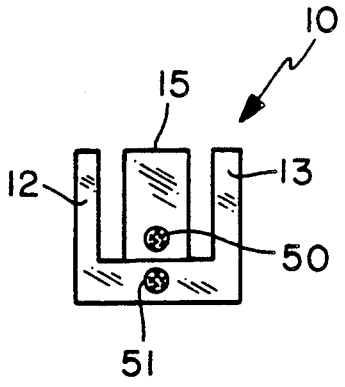
FIG. 5 is rear view of the sighting device illustrating the use of luminescent sights to permit aiming and shooting under low-light conditions.

A further feature of the present invention is that my channel sight can be combined with illuminated sources to provide for night time shooting. FIG. 5 shows a rear view of my channel sight 10 with a radioluminescent dot sight 50 located on the back of front sight post 15 and a second radioluminescent dot sight 51 located on back end of channel sight 10. The radioluminescent sights are described in my U.S. Pat. No. 3,641,676. In my preferred embodiment I use a luminescent gas such as tritium or promethium in the dot sights to provide the necessary illumination for night time shooting. Although radioluminescent sights are preferred, other light sources could be used for providing illuminated sights for night time shooting. The circular or luminescent dot sights 50 and 51 have a diameter of approximately 0.080 inches and are positioned above and below the bottom of the channel. To properly align the illuminated sights with the target, the user moves sight 10 until the dot sights 50 and 51 appear as a figure eight. Thus the invention provides for rapid two-eye aiming and shooting under daytime conditions and if used with illuminated sight posts, also permits aiming and shooting under night time or low light conditions.

Figure 6:
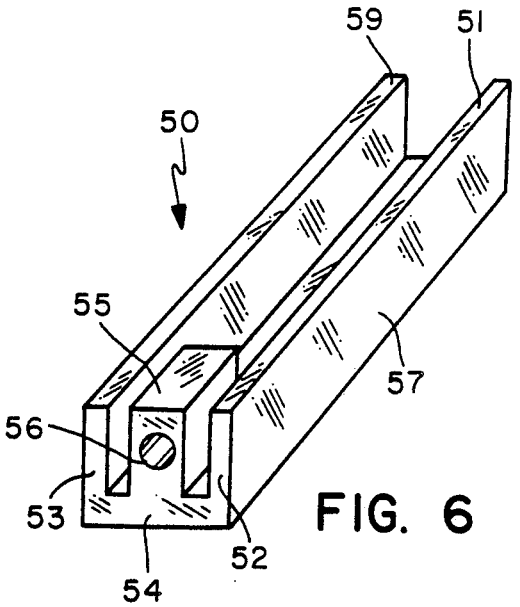
FIG. 6 is a perspective view of an alternate embodiment of my sighting device for mounting on top of a weapon.
Figure 7:
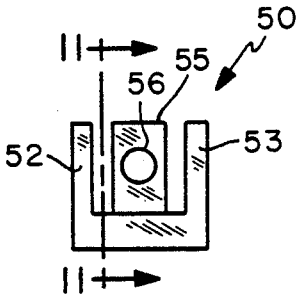
FIG. 7 is a rear view of the sighting device of FIG. 6 illustrating the use of an open hole through the front post.

Referring to FIGS. 6 and 7, reference numeral 50, identifies an alternate embodiment of my improved channel sight for mounting on a weapon for daytime and low level light or when the target is illuminated by artificial light. My sight comprises a U-shaped channel 50 formed by a first rectangular shaped sidewall 52, a bottom section 54 and a second rectangular shaped sidewall 53. Located on top of sidewall 52 is a light reflecting surface 51 and located on top of sidewall 53 is a light reflecting surface 59 which is parallel to light reflecting surface 53. Light reflecting surfaces 52 and 53 are located on the topmost portion of sight 50 and identical to the embodiment of FIG. 1 to provide prominent surfaces that contrast with the handgun to permit a user to quickly aim the weapon in daylight conditions without the user closing one eye. The embodiment of FIGS. 6 and 7 differ from the embodiment of FIG. 1 in that I have provided an opening 56 that extends through the front post 55. I have discovered that in low light conditions the use of a hole in the front sight provides background illumination to assist the shooter in lining the weapon with the target. The hole 56 is particularly useful when aiming a weapon at an illuminated object since light appears through opening 56 in the sight post indicating that the user is on target. It should be pointed out that the opening is sufficiently small 0.086" in diameter so as not to provide a sight picture of an object but to merely display the lumination of the object the weapon is aimed at.

Figure 8:
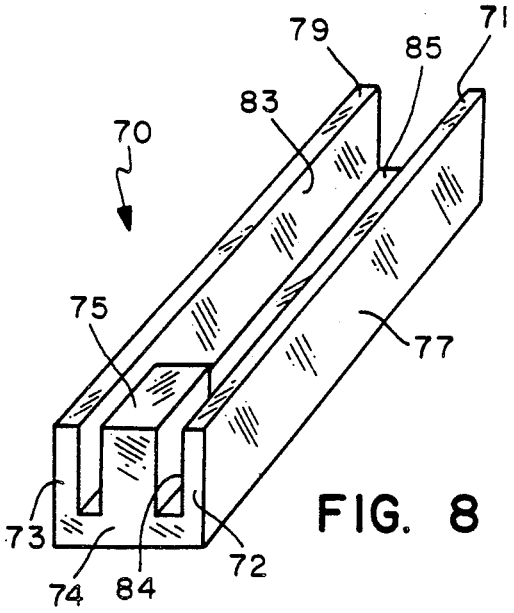
FIG. 8 is a perspective view of a further alternate embodiment of my sighting device for mounting on top of a weapon.
Figure 9:
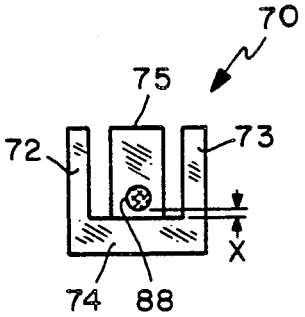
FIG. 9 is a rear view of the sighting device of FIG. 8 illustrating the use of a luminous sight with reflective sight channels.

Referring to FIGS. 7 and 8 reference numeral 70 identifies my improved channel sight for mounting on a weapon. My sight comprises a U-shaped channel 70 formed by a first rectangular shaped sidewall 72, a bottom section 74 and a second rectangular shaped sidewall 73. Located on top of sidewall 72 is a light reflecting surface 71 and located on top of sidewall 73 is a light reflecting surface 79 which is parallel to light reflecting surface 72. Light reflecting surfaces 12 and 13 are located on the topmost portion of sight 10 and provide prominent surfaces that contact with the handgun to permit a user to quickly aim the weapon in daylight conditions without the user closing one eye. Located on the inside of sidewall 73 is a light reflecting surface 83 and similarly located on the inside of sidewall 72 is light reflecting surface 84. Similarly located on the bottom of sight 70 is a light reflecting surface 85. Typically, the light reflecting surfaces may be a polished metal surface. I have discovered that the use of interior reflective surfaces 83, 84, and 85 on the sight of FIG. 8 and FIG. 9 provides additional enhancement in aiming the weapon in nighttime and low light conditions. That is, if the interior surfaces are polished to reflect light, and the user immediately sees the reflection of the luminescent dot 88 on the sidewalls or the bottom of the channel the user knows the sight is out of line. When the luminescent dot does not reflect off the sides or bottom of the sight back to the user, the user knows that the weapon is aimed correctly. Luminescent dot 88 mounts a small distance from the bottom of channel 85, typically 0.01 inches. If the reflection is from the insides 83 or 84 the user knows the windage aim is incorrect. If the reflection is from the bottom of the channel 85 the user knows the elevation aim is incorrect. When the single dot appears with the target and without reflection the weapon is properly aimed. The length of my channel sight is determined by the desired accuracy of the sight. That is, with a longer sight channel one can obtain greater shooting accuracy than with shorter sight channels. In most applications a sight length of approximately 4 inches provides a preferred accuracy.

Figure 10:
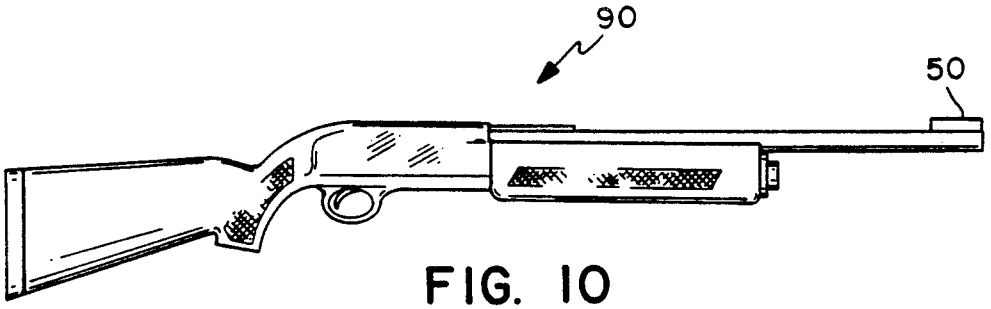
FIG. 10 is a side view of a sighting device mounted on a shotgun.

FIG. 10 shows my sight 50 mounted to a shotgun 90.

FIGS. 11–19 shows an alternate embodiment of my invention that permits a user to place different colored disposable inserts in the opening in my single front sight post located in my channel sight. The purpose of using different colored sights is to permit the user to select the proper color sight for the target. For example if one were hunting down bear one could place a sight insert of contrasting color in the sight post to provide sharp contrast between the target and the sight post insert. When viewing the channel sight of the present invention it is apparent that a single front sight post with an opening therein is located between the side channels at the front most portion of the gunsight.

Figure 11:
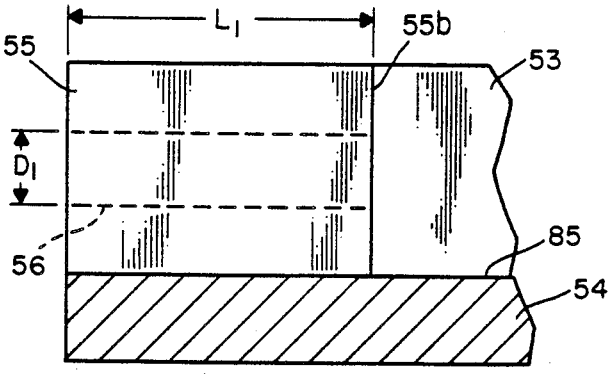
FIG. 11 is a side view of the sight post in my channel sight.

FIG. 11 shows a partial sectional view taken along line 1—1 of FIG. 7 to illustrate the single sight post used in the present invention. Sight post 55 includes an elongated cylindrical opening 56, which is parallel to the bottom surface 85 of my channel sight. The diameter of the opening in post 55 is designated as D1. It is this opening 55 where a user can install or insert the appropriate color so that the sight post insert contrast with the target. In the preferred embodiment I utilized inserts that are made of translucent material so that they pick up light from the region in front of the gunsight. Typical translucent materials are polymer plastics. The use of a translucent or light conducting material functions to direct light from in front of the sight into the rear of the insert that is located between the sidewalls. The result is that the end of the translucent material appears as if it contained a colored light source.

Figure 12:
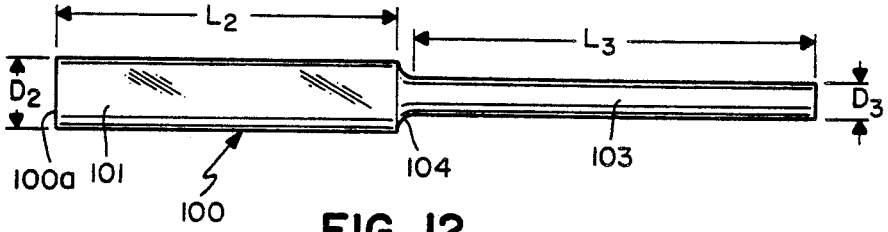
FIG. 12 is a side view of a disposable insert for sight post.

FIG. 12 shows a translucent sight insert 100 for insertion into opening 56 and then cut to fit the sight post. Translucent insert 100 is made from a translucent and resilient material such as a polymer plastic or the like. Insert 100 comprises a cylindrical base 101 of diameter D2 and a tongue 103 of diameter D3. Diameter D2 is slightly smaller than dimension D1 so that when the base 101 is inserted into opening 56 it forms a tight frictional fit in opening 56. The cylindrical base has a dimension L2 which is slightly longer than the length of opening L1 in sight 55. The longer length insures that when the user cuts the insert to length the insert located in the opening 55 will uniformly fill opening 56. Tongue 103 also has a dimension L3 which is also longer than the dimension L1. The use of a tongue 103 that is longer than the opening 56 permits a user to quickly and easily insert one end of the smaller diameter tongue completely through the sight post by allowing the user to pull the base portion 101 into opening 56 rather than pushing the base portion into opening 101. That is, if the cylindrical base is somewhat resilient pushing the base into the opening would produce a diametrical expansion of the base produces a narrowing of the diametrical base thus easing the insertion of the base into the opening 56.

Figure 13:
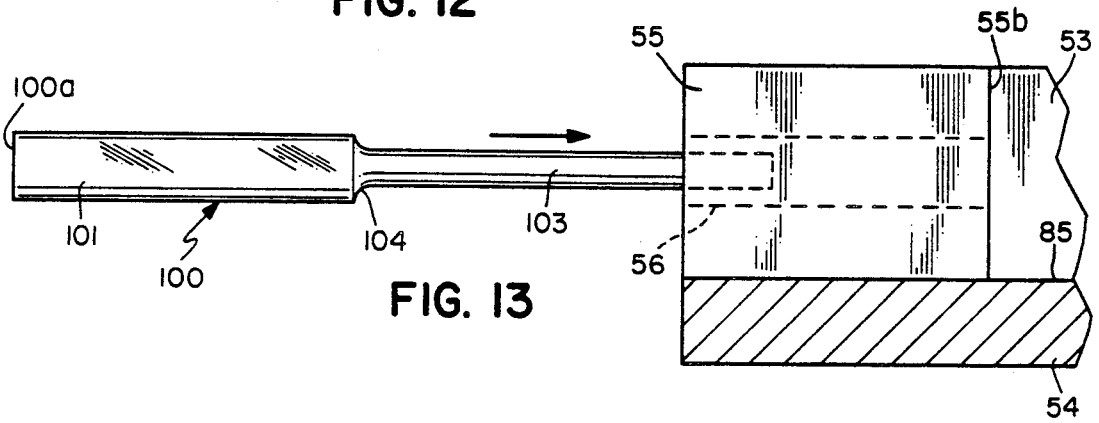
FIG. 13 illustrates a disposable insert being inserted into the opening in my sight post.
Figure 14:
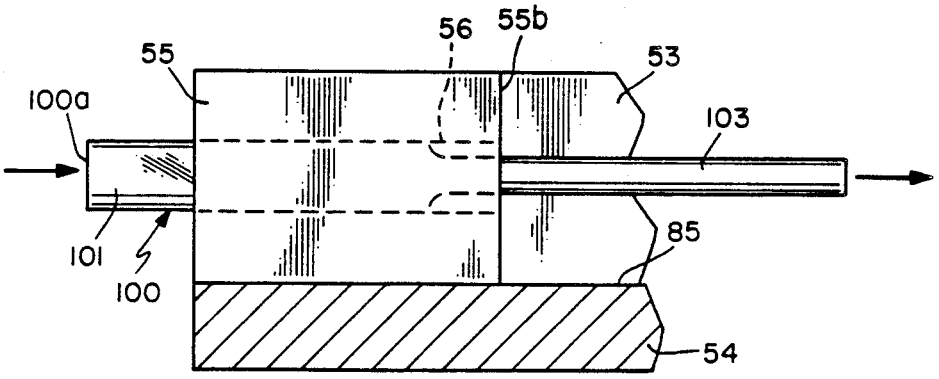
FIG. 14 shows a disposable insert being pulled into the opening in my sight post.
Figure 15:
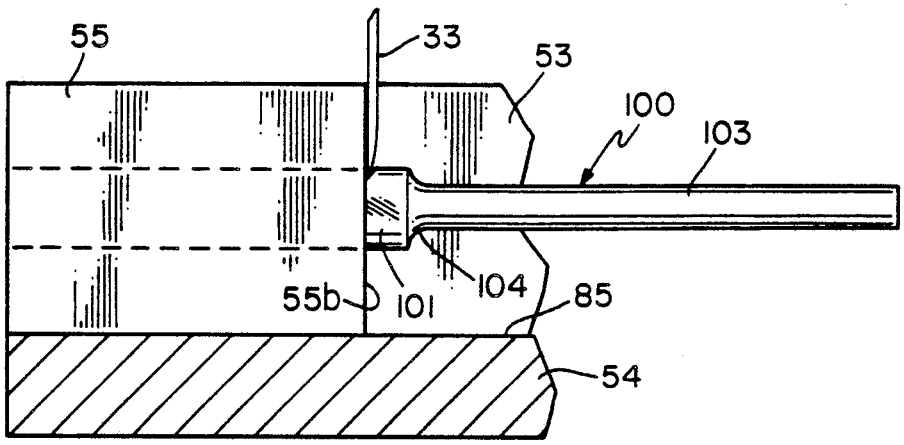
FIG. 15 shows my disposable insert located in the sight post.
Figure 16:
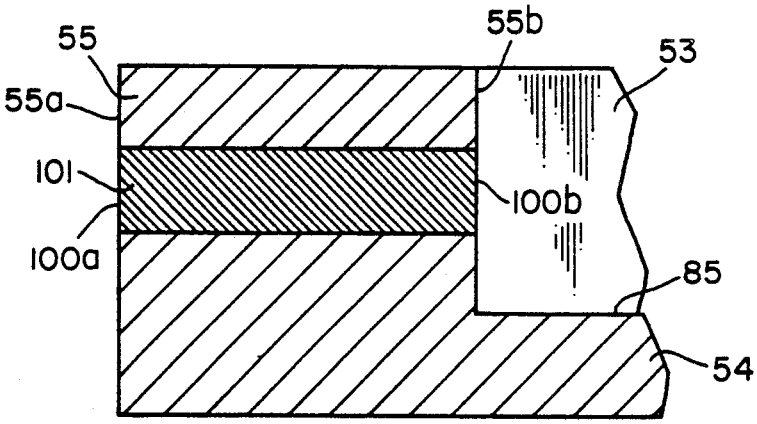
FIG. 16 shows may sight post with the end of the disposable sight cut flush with the end of the sight post.

In order to understand how one inserts a translucent sight insert into opening 56 reference should be made to FIGS. 13 to 16. FIG. 13 shows the narrower or tongue end 103 of insert 100 partially inserted into opening 56. (indicated by arrow) Once the end of tongue 103 extends through opening 56 the user grasps and pulls on the end of tongue 103 to pull base 101 into position as illustrated by FIG. 14 and FIG. 15.

Once the translucent sight insert is pulled into place as shown in FIG. 15 a user takes a knife 33 and cuts off the end of base 101 to leave cut base 101 as an insert in post 55. Note, after cutting one end of insert 101 is flush with sight post front surface **55*a* and the other end of insert 101 is flush with sight post 55*b*** rear surface.

The insert 101 is shaded to indicate the color green. A green insert permits the user to have a sight post that contrasts with a target having a different color. For example if the user was shooting at a brown target.

Figure 17:
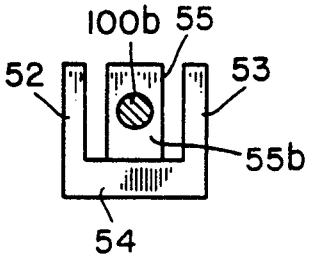
FIG. 17 shows and end view of my sight post with the disposable insert.

FIG. 17 shows how sight post 55 with end **100*b* of cylindrical base contrasting with sight post 55** when the user aims the weapon with my gunsight.

Figure 18:
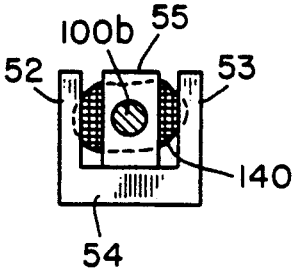

FIG. 18 illustrates how a black target 140 might appear to a shooter as the shooter sights in on the black target using the translucent sight insert **100*b*** to aim at the target. The use of the translucent sight inserts permits the user to pick up light from in front of the gunsight so that the insert contrasts with the region directly behind the sight post that is the area partially shaded by the channel sidewalls and the sight post.

If the user wishes to change the sight insert he or she merely pushes out the old insert 100 and inserts the new insert 110 in opening 55.

Figure 19:
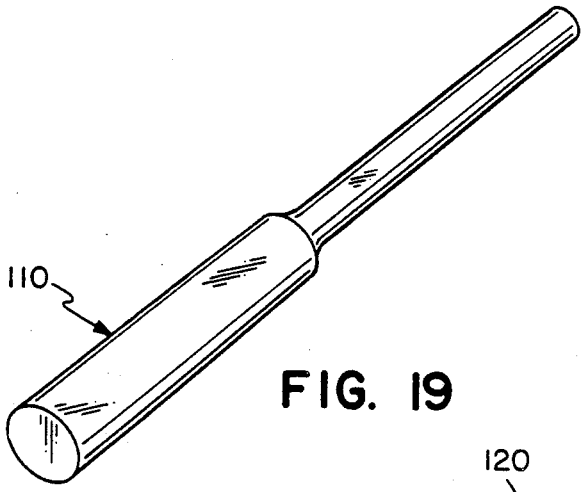
FIG. 19 shows another color disposable insert for replacing one disposable insert with another disposable insert.

FIG. 19 shows a sight insert 110 that is identical in size to sight insert 100 except sight insert 110 is a different color that sight insert 100.

Figure 20:
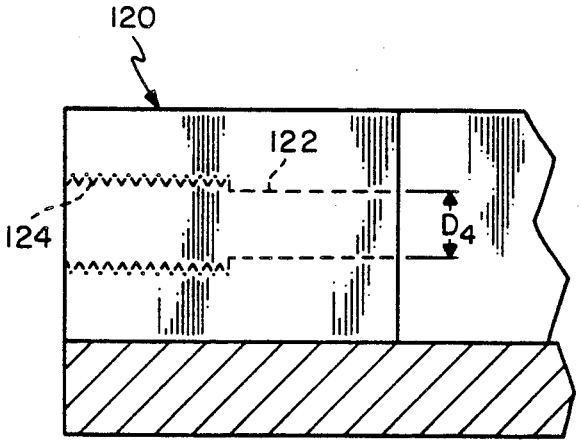
FIG. 20 shows a sight post for receiving a reusable insert.
Figure 21:
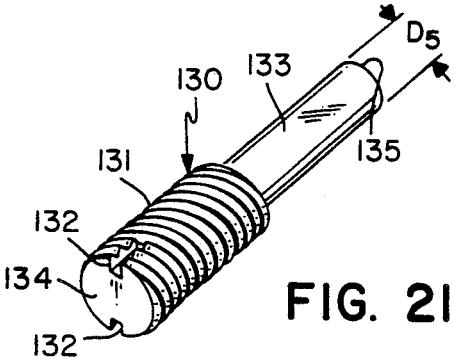
FIG. 21 shows a reusable insert for use with the sight post of FIG. 20.
Figure 22:
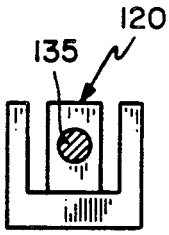
FIG. 22 shows an end view of my channel sight with a reusable insert.

FIGS. 20–22 show a still further embodiment of my invention that uses a reusable translucent insert that is made from a material such as acrylic. An example of a material is a polymeric plastic such as Lexan. The embodiment of FIG. 20 differs from the embodiment of FIG. 12 since the insert need not be made of resilient material. FIG. 20 illustrates a sight post 120 that is identical to sight post 55 except that the opening in sight post 120 is stepped and includes threads for threadingly inserting or removing a threaded translucent insert. Sight post 120 includes a first larger diameter opening having threads 124 and a smaller diameter cylindrical straight section 122 of diameter D4.

The reusable translucent insert 130 is shown in FIG. 21 and comprises a threaded section 131 for engaging threads 124 and a cylindrical section 133 of diameter D5 for fitting into cylindrical opening 122 in sight 120. Located on the end face 134 are notches 132 that permit a user with a spanner type wrench to screw sight insert 130 into position in sight post 120. Insert 130 is preferably made from a hard polymer plastic and does not require the resiliency of the material to hold the insert in place since the threads both hold the insert in place and permit a user to replace the insert as needed.

FIG. 22 illustrates how the end 135 of insert 130 is visible to a user who is aiming at a target. Note the notches 132 are not visible since the diametrical dimension between notches 132 is less than the diameter D4 of opening 122. Also the opening D4 and the diameter D5 of member 133 are within a couple thousands of an inch to permit the section 133 to fit snugly into the opening 122.

In the present invention I prefer to mount my sighting device on the end of a shotgun with the sighting device having an overall dimension of about four inches. I have found that a sight length of about four inches is ideal for most shoulder weapons since it provides sufficient sight length to permit the user to accurately aim the weapon. I do not need a rear sight since the elongated channel directs the shooters eye along the channel member and around the single sight post located in the front of the gunsight. As illustrated in FIG. 18 the shooter typically sees two rectangular shaped regions on each side of the sight post. By sighting along the channel and around the sight post the shooter can locate the target with respect to the channel and the sight posts. The colored insert which picks up light from the region in front of the sight permits the user to easily see the contrast between the colored insert and the target thus assisting in alignment of the sights with the target.

Figure 23:
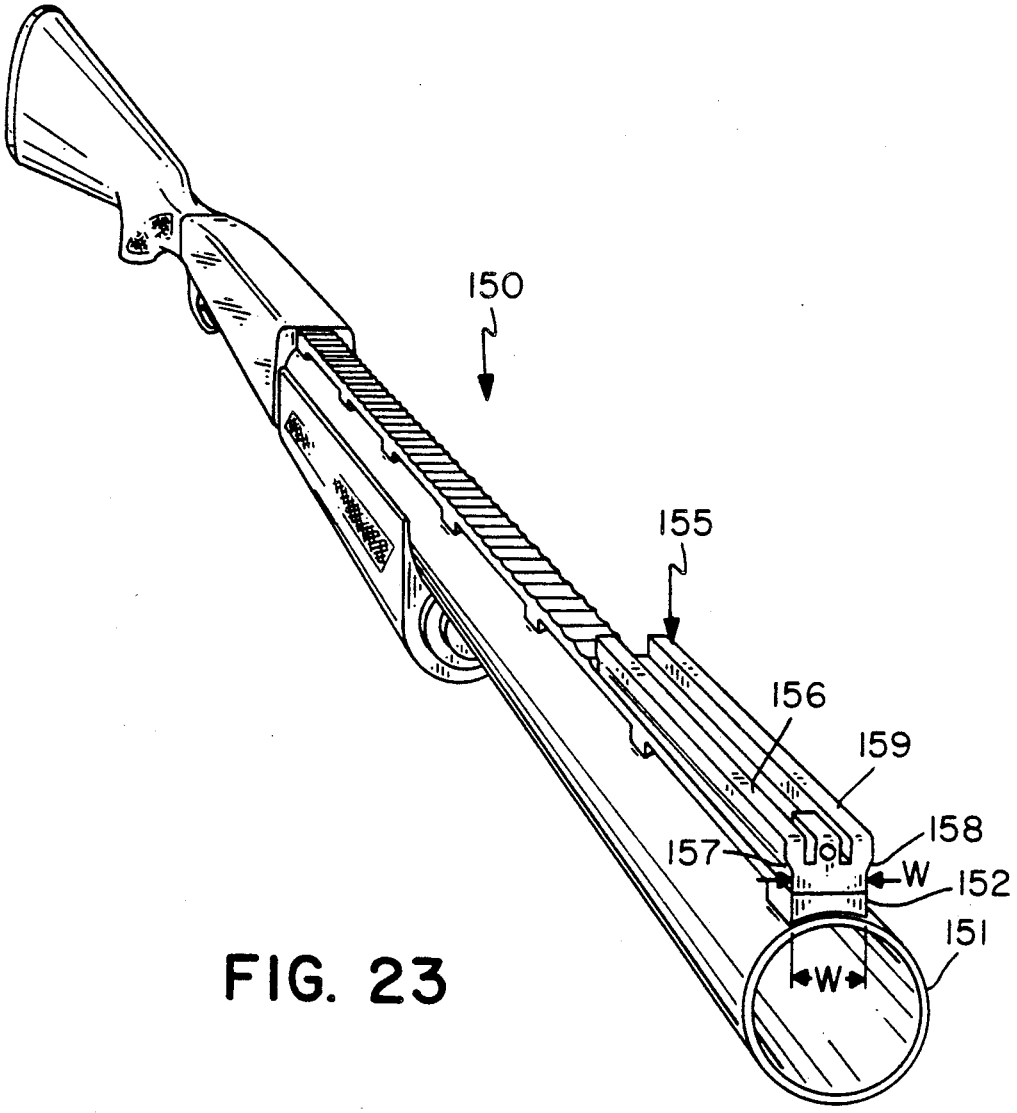
FIG. 23 is a pictorial view of my channel sight on a vent rib shotgun.

Referring to FIG. 23 reference numeral 150 shows my channel sight 155 located on a vent rib shotgun. The channel sight 155 includes a side channel 156 that has a face 157 that tapers inward to mate with the rib 152 located on barrel 151. Similarly, side channel 159 includes a face 158 that tapers inward to mate with rib 152. The reference letters W denote that the width of the bottom of channel sight 155 and rib 152 are the same dimension so that the channel sight 155 blends into the vent rib to permit more air around the sight for wing shooting. The use of a sight that has a width the same as the vent rib also permits the sight to be self aligning as one mounts the sight to the rib preferably through screws or the like.

FIG. 24 to FIG. 33 show the various embodiments of my sight that permit a suer to aim and shoot a weapon with both eyes open by using either my channel sight alone or my channel sight in combination with a rear sight. The advantage of the embodiments of FIG. 24 to FIG. 33 is that both eyes open shooting can be used to sight on a target in three different ways. As previously mentioned my front channel sight with the top rails permits one to rapidly aim and fire the weapon. In addition the user can more precisely aim the weapon by using only the channel sight with my interior sight post. This provides the first precise aiming position for a first distance. The inclusion of a flip up rear sight permits the retention of all the advantages of my channel sight but provides the additional benefit of having a weapon sighted in for a second precise aiming position. For example, the channel sight with the interior sight post may be sighted in for a first precise aiming position of 25 yards. The channel sight with the interior sight post in combination with my rear sight may be sighted in for a second precise aiming position of 75 yards. Thus with the use of a rear sight in conjunction with my front channel sight the user has the option of any of three different sighting positions while maintaining the learned discipline of shooting at a target with both eyes open.

Referring to FIG. 24 to FIG. 27 reference numeral 50 identifies handgun 9 with my channel sight 50 located on the front portion of the handgun. It should be pointed out that identical parts in FIGS. 1–23 are identified with identical reference numbers. Located on the rear of handgun 9 is a flip up rear sight 200 that can be used with my front channel sight 50 to provide handgun 9 with the capability for one to aim the handgun with both eyes open using only my front channel sight or the combination of my front channel sight and a rear sight. That is, with flip up sight 200 in the down position as shown in FIG. 26 the user can use my front channel sight as a both eyes open sight for either fast shooting or for more precise shooting as described previously. With the inclusion of a flip up sight 200 on the rear of the handgun the user can now have the benefit of a second precise aiming setting that is beyond the range of the first precise aiming position of the front sight. That is, as a bullet leaves the barrel of a gun the bullet continually drops under the force of gravity. Consequently, a gun sighted in at a distance of 20 yards would have a different sight adjustment than a gun sighted in at 100 yards. The present invention permits the user to have the sights positioned so that there are two precise aiming position on one gun. A first precise aiming setting which is determined only by the front channel sight and a second precise aiming setting that is determined by the shooter using the combination of the front channel sight and a rear sight. The use of my channel sight with a flip up rear sight provides the further advantage in that although the sight picture presented by the combination of the channel sight and the rear sight resembles that of a normal sight picture of rear and front sights the use of my channel sight as a front sight automatically shields one of the user eyes from the sight picture to permits the user to shoot with both eyes open regardless of what sights the user is using. Consequently, the user does not have to make any adjustment to learned discipline of both eye open shooting position that is used when my channel sight is used alone.

Referring to FIG. 25 reference numeral 200 identifies the flip up rear sight that has a general U-shape with a pivotal mount 204 connecting the flip up sight 200 to the top of gun 9 through a bracket 205. Located in sight 200 is a U-shaped positionable blade 202 that is held in position by screw 203. That is, to sight in the gun blade 202 can be adjusted up or down or sideways by loosing screw 203 which frictionally holds blade 202 in position sight 200. The rear sight may contain an alignment marking 212 or a spot mark 211 to act as reference markings. The opening in blade 202 is in a U-shape that has two edges that are located parallel to the sidewalls of my channel sight 50 and a cross edge that is located parallel to the bottom surface of my channel sight.

FIG. 26 illustrates gun 9 with the flip up sight 200 in the down position so that a user can aim and shoot using only front channel sight 50.

FIG. 27 illustrates the opposite side of my sight showing a screw 210 for adjusting the force necessary to permit one to flip up or down sight 200.

Figure 33:
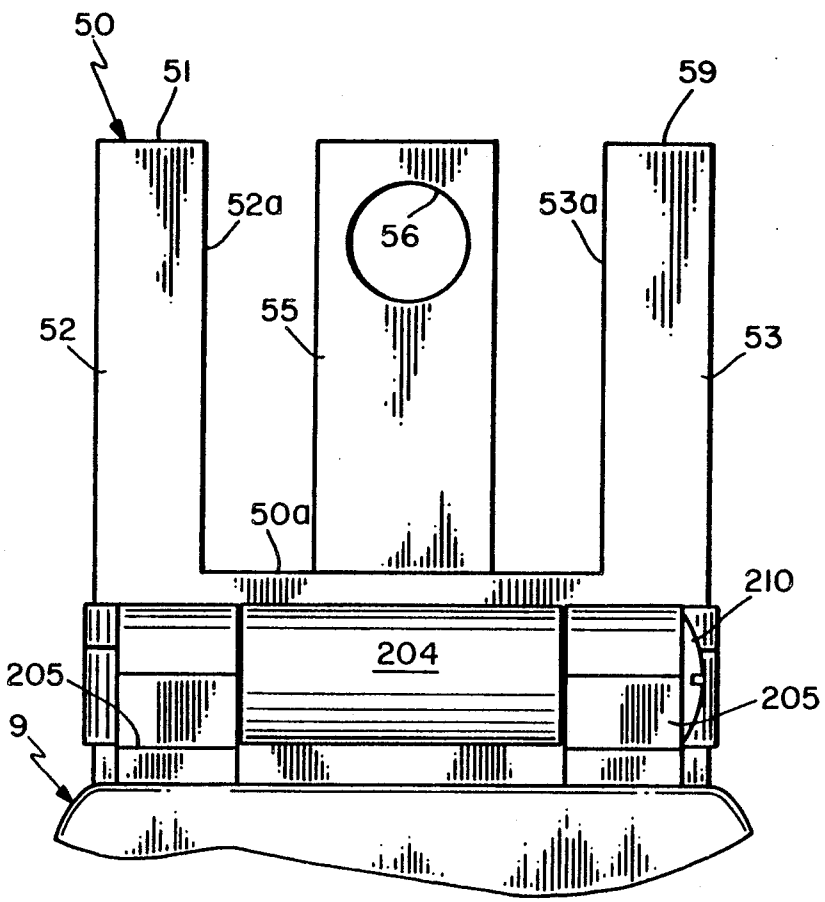
FIG. 33 illustrates the sight picture presented to a viewer when the flip up sight is in the down position.
Figure 32:
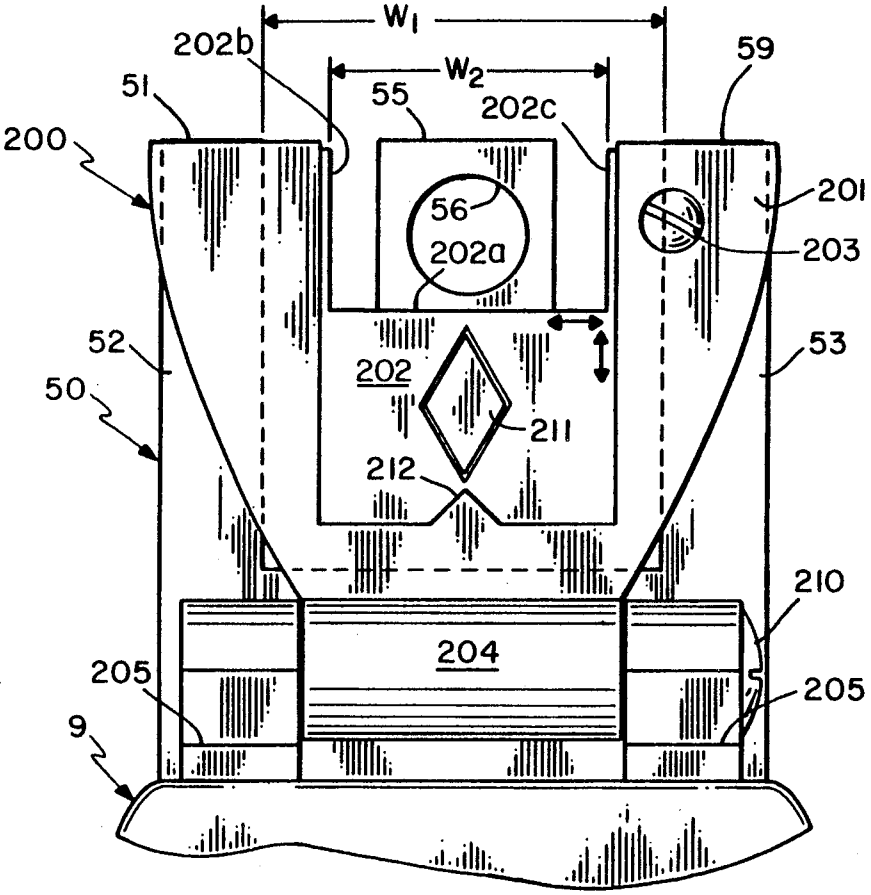
FIG. 32 illustrates the sight picture presented to a viewer when the flip up sight is in the up position.

In order to appreciate how the sight picture appears to one using my channel sight 50 in combination with a rear sight 200 reference should be made to FIG. 32 which shows flip up sight 200 in the up position for shooting with both channel sight 50 and rear sight 200 and to FIG. 33 which shows flip up sight 200 in the down position for shooting with only channel sight 33.

Referring to FIGS. 32 and 33 the U-shaped opening in rear sight is defined by the edges of blade 202 and comprise a crossedge **202*a* and a first vertical side edge 202*b* and a second vertical side edges 202*c*. Note, side edges 202*b* and 202*c* are parallel to side walls 52*a* and 53*a* of channel sight 50 and the cross edge 202*c* is parallel to the bottom surface 50*a* of channel 50. Channel sight 50 includes channel walls that are partially illustrated in dotted lines in FIG. 32 and are spaced apart a distance W1. Similarly, the edges 202*b* and 202*c* of blade 202 are spaced apart a distance denoted by W2 which is less than the distance W1. The spacing of the rear sight opening in W2 at a distance less than the width W1 of front channel permits the rear sight to block out the interior side walls of channel sight 50 for sighting purposes. Consequently, as illustrated in FIG. 32 when the user aims at a target the lower edge 202*a* can be aligned with the top edge 55 or opening 56** and the target in much the same manner one would aim a conventional weapon having a front and rear sight. One important difference exists between the prior art sights and the present sight combination. With conventional front and rear sights the user closes one eye and aims with the other. With the present invention the sight picture appears as a conventional front and rear sight picture but without the user having to close one eye to shoot since the front channel side walls block out the view for one of the users eyes. Thus the user preserves the learned technique to shoot with both eyes open and at the same time have a weapon that can be used for rapid aiming and is also sighted in for two different distances.

FIG. 33 illustrates how the rear sight picture appears to a user when the flip up sight 200 if flipped down. Note sight 200 does not interfere with the previously described precise aiming using only front sight 50.

Figure 28:
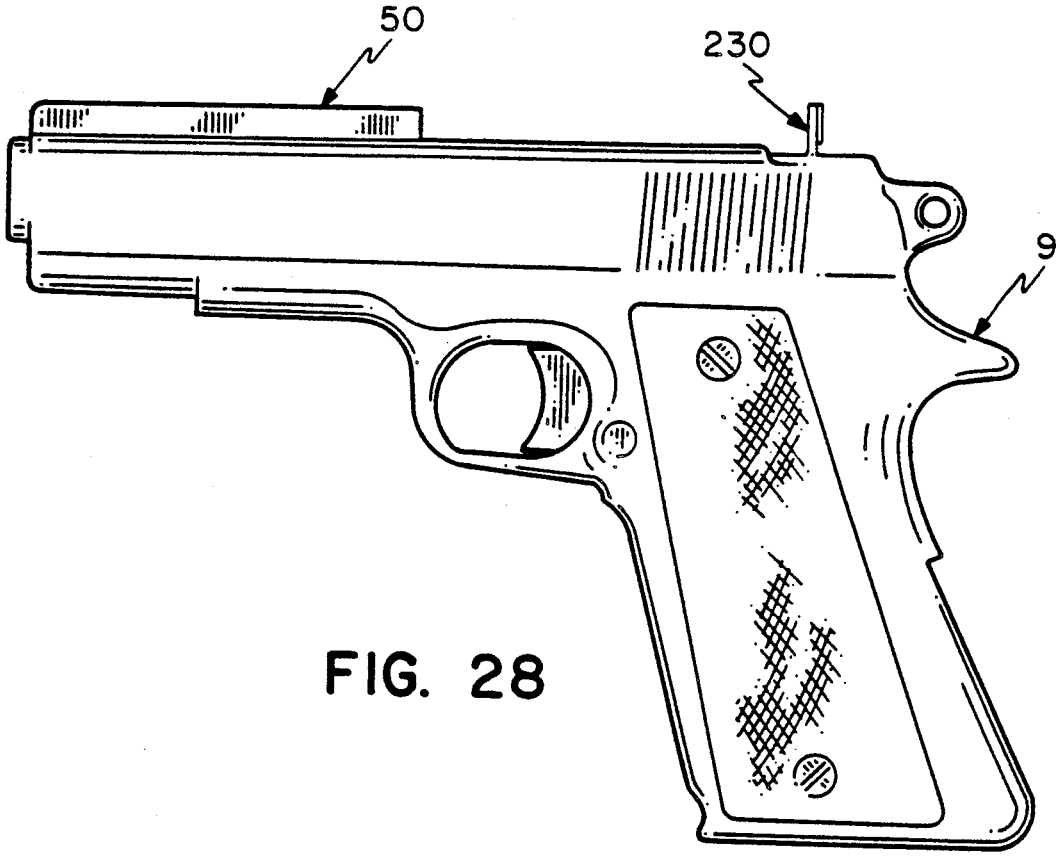
FIG. 28 is an alternate embodiment of the invention that uses a permanently mounted rear sight in conjunction with my channel sight.
Figure 29:
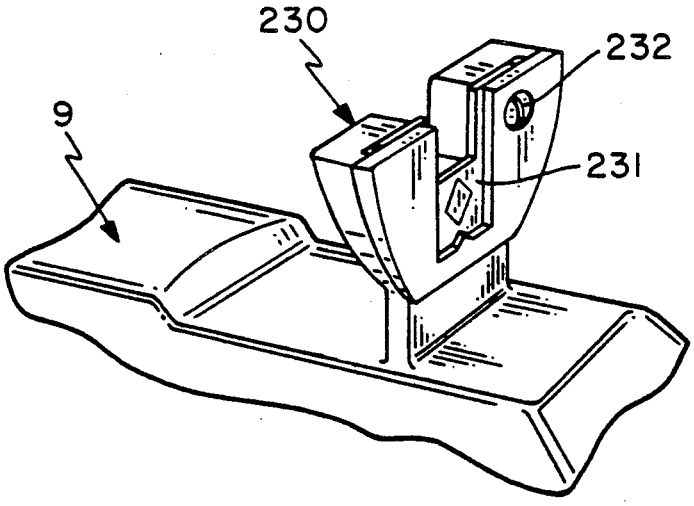
FIG. 29 is a perspective of the permanently mounted rear sight of FIG. 28.

FIG. 28 illustrates an alternate embodiment of my invention that uses a permanent mount rear sight with my front channel sight. While the combination of the two sights prevents one from obtaining the full benefits of two precise aiming position sight settings it has been found that my channel sight used in conjunction with a fixed rear sight is useful for those people who having learned the technique of shooting with both eyes open and want to continue to aim and shoot with both eyes open regardless of types of sights used.

Figure 30:
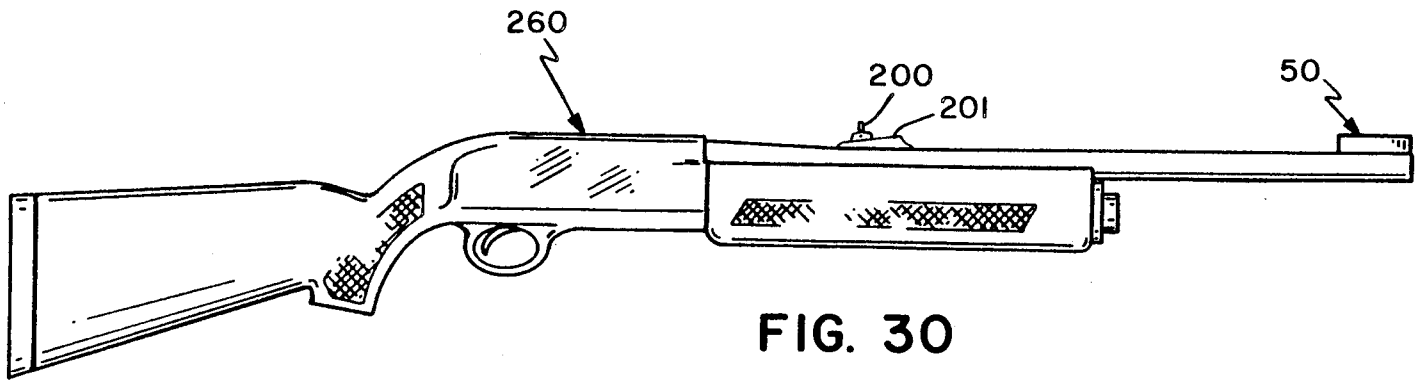
FIG. 30 shows may channel sight located on the front of a rifle with a flip up rear sight positioned about in the middle of the barrel region of the rifle.

FIG. 30 illustrates a rifle 260 having channel sight 50 on the front of the barrel and the flip up sight 200 located about halfway back on the barrel on a ramp 201 that permits a user to have further vertical adjustment of flip up sight 200.

Figure 31:
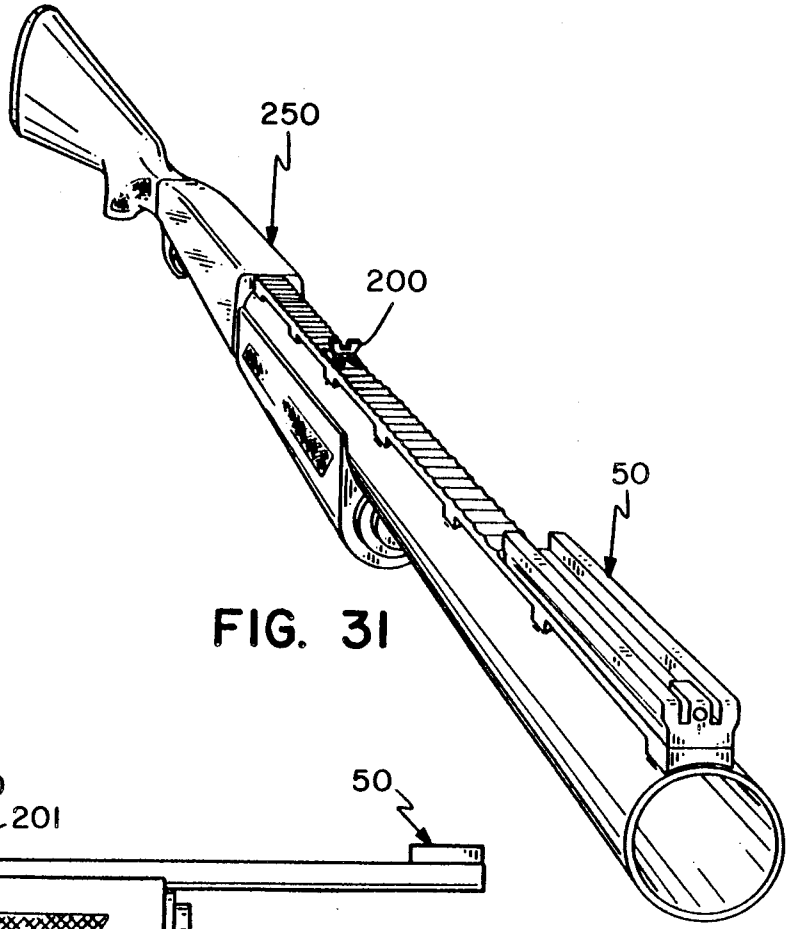
FIG. 31 shows my channel sight located on the front of a vent rib shotgun with a flip up rear sight positioned about in the middle of the barrel region of the rifle.

FIG. 31 illustrates a vent rib shotgun 250 having channel sight 50 on the front of the barrel and the flip up sight 200 located about halfway back on the barrel. Flip up sight 200 is located directly on the vent rib of the shotgun and does not require a ramp since my front channel sight is located directly on the rib in a manner similar to a handgun. The advantage of using a flip up sight on the shotgun is that the user can now have the shotgun sighted in at two different ranges. A first range based on only using the front channel sight and a second range in using both the flip up sight and the front channels sight.

The purpose having the flip up sight about halfway along the barrel is to get the rear sight away from the users eye so the user can more easily focus on the two sights and the target. Although not fully understood, with the present invention of spacing the rear flip up sight about two feet away from the users eyes provides a sharper focus of the sights and the target. That is, when the user aims and shoots with both eyes open both the target and the front and rear sights remain in sharp focus with my invention whereas sighting a target with conventional sights that require closing one eye while viewing the sights and the target do not present the user with the sights and target in such sharp focus.

I claim:

1. A weapon with two precise sighting positions to permit the user to aim and shoot from either precise shooting position with both eyes open comprising:

a weapon having a front and a rear;

a channel sight mounted on the front of said weapon, said channel sight comprising a channel member having a front and a rear, said channel member having a first sidewall extending upward, said first sidewall having a first surface extending upward;

said channel member having a second sidewall extending upward, said second sidewall having a first surface extending upward, said channel member having a front and a rear;

said channel member having a bottom section connecting said first sidewall to said second sidewall, said first surface of said first sidewall and said first surface of said second sidewall forming an open sighting channel with no obstructions to the user viewing said first surface of said first sidewall and said first surface of said second sidewall from a sighting position behind the rear of said channel member;

a sight post extending upward from said bottom section, said sight post spaced between said first surface of said first sidewall and said first surface of said second sidewall, said sight post and said sidewalls forming a first precise sighting position to thereby enable a user to precisely aim a weapon attached to said channel sight by sighting through and channel and around said sight post; and a rear sight located on said weapon, said rear sight positionable between an up condition that permits the user to use said rear sight in combination with said channel sight to form a second precise aiming position and a down condition not useable as a sight, said rear sight located on the rear of said weapon, said rear sight having a lower sight edge and a pair of vertical sight edges so that when said rear sight is positioned in the up condition it permits a user to precisely sight an object with both eyes open by aligning a target with said sight post between said pair of vertical sight edges and said lower edge and when said rear sight in the down condition it permits the user to solely use said channel sight for either quick aiming or as the first precise aiming position.

2. The sighting device of claim 1 wherein said rear sight includes a U-shaped opening having a pair of side edges and a cross edge with said side edges located parallel to said sidewalls of said channel sight.

3. The sighting device of claim 2 wherein said channel sight has a width between said channels sidewalls denoted by W1 and said U-shaped opening in said rear signal has a width denoted by a dimension W2 wherein said dimension W2 is less than W1 so that a user aiming a weapon using both said channel sight and said rear sight will obscure said sidewalls as sighting surfaces.

4. The sighting device of claim 2 wherein said weapon comprises a shotgun having a barrel of a first length and said rear sight is located about midway on said barrel.

5. The sighting device of claim 2 wherein said weapon comprises a rifle having a barrel of a first length and said rear sight is located about midway on said barrel.

6. The sighting device of claim 2 wherein said weapon comprises a handgun.

7. The sighting device of claim 2 wherein said rear sight includes a positionable blade to permit a user to adjust said positionable blade for sighting in said weapon at a predetermined range.

8. The sighting device of claim 2 wherein said sight post has an opening therein to permit one to insert a translucent material.

9. The sighting device of claim 2 wherein said positionable rear sight includes means to prevent moving said rear sight from an up position to a down position so the user using said weapon must use both said channel sight and said rear sight to aim at a target.

10. The sighting device of claim 2 wherein said rear sight includes a pivotable mount to permit a user to flip said rear sight to an up position or a down position.

11. A sighting device for mounting on the front end of a weapon to permit the user to select the sight post color in accordance with the color of the target the user is shooting at comprising:

a channel member having a first sidewall extending upward, said first sidewall having a first topmost light reflective sighting surface thereon;

a second sidewall extending upward, said second sidewall having a second topmost light reflective sighting surface thereon, said first light reflective sighting surface parallel to said second light reflective sighting surface to quickly guide the user's eye into initial alignment with a target and said first and second light reflective sighting surfaces;

a sight post, said sight post having an opening therein for receiving an insert, said sight post spaced between said first sidewall and said second sidewall, said sight post and said sidewalls operable to enable a user to precisely aim a weapon attached to said channel sight; and a colored insert located in said opening in said sight post with said colored insert selected to provide a color that contrast with the color of the target.

12. The sighting device of claim 11 wherein said sight post has a front and a rear and said insert comprises a translucent material to gather light from in front of the sight post and transmit the light to the rear of the sight post to provide a contrasting color with the color of a target.

13. The sighting device of claim 12 wherein said sighting device is mounted on the end of a shotgun.

14. The sighting device of claim 13 wherein said insert forms a friction fit with the opening in said sight post.

15. The sighting device of claim 13 wherein said insert includes threads and said opening in said sight post includes mating threads to permit a user to threadingly insert said insert into the opening in said sight post.

16. The sighting device of claim 13 wherein said first sidewall and said second sidewall extend at least 0.250 inches above the top of a barrel fastened to said sighting device and said first sidewall and said second sidewall have a length approximately four inches or less.

17. The sighting device of claim 1 including screws to hold said sighting device on a weapon.

18. A sighting device for mounting on the top of a gun comprising:

a channel member having a first sidewall extending upward;

said channel member having a second sidewall extending upward, said channel member having an elongated opening therein;

a sight post located in said channel member, said sight post spaced between said first sidewall and said second sidewall, to permit a shooter to aim at a target by sighting along the elongated opening and between said sidewalls and said sight post in said channel member, said sight post having an opening of a first diameter therethrough to permit a user to install an insert in said opening; and a colored insert for insertion in the opening in said sight post, said colored insert including means to retain said colored insert in the opening in said sight post, said insert having a contrasting color with a target so that said insert provides a color contrast with a target sighted in the opening between said sidewalls and said sight post.

19. The sighting device of claim 18 wherein said colored insert has a first cylindrical body section of a first diameter and a second cylindrical tongue section of a second diameter with said first diameter less than said second diameter and said first diameter less than diameter of the opening in said sight post so that the user can use said tongue section to pull said body section into frictional engagement in the opening in said sight post and said means comprises an interference fit between the diameter of said opening and said body section first diameter.

20. The sighting device of claim 19 wherein said insert comprises a soft material that can be cut with a knife to permit the user to cut the end of said insert flush with said sight post.

21. The sighting device of claim 18 wherein said gun is a shotgun.

22. The sighting device of claim 18 wherein said channel member has a bottom section with said insert spaced from said bottom section.

23. The sighting device of claim 18 wherein said insert comprises a cylindrical translucent plastic material providing a circular colored insert spaced equal distance from said sidewalls of said channel member.

24. The sighting device of claim 18 including a signal sight post spaced equal distance from said sidewalls of said channel member.

25. The sighting device of claim 18 wherein said sight post and said channel members are of equal height so as to define openings forming a rectangular shaped sight pattern on opposite sides of said sight post.

26. The sighting device of claim 18 wherein said channel sight has sides that taper inward to a dimension that is equal to the width of a member on said gun so that said sighting device is self aligning with said member on said gun when said channel sight is attached to a member on said gun.

* * * * *